US007478676B2

(12) United States Patent
East, Jr. et al.

(10) Patent No.: US 7,478,676 B2
(45) Date of Patent: Jan. 20, 2009

(54) METHODS AND DEVICES FOR TREATING MULTIPLE-INTERVAL WELL BORES

(75) Inventors: Loyd E. East, Jr., Tomball, TX (US); Perry Wayne Courville, Houston, TX (US); Richard Altman, Kingwood, TX (US); Robert Clayton, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 256 days.

(21) Appl. No.: 11/450,654

(22) Filed: Jun. 9, 2006

(65) Prior Publication Data

US 2007/0284109 A1 Dec. 13, 2007

(51) Int. Cl.
*E21B 33/122* (2006.01)
*E21B 43/14* (2006.01)

(52) U.S. Cl. ..... 166/305.1; 166/191; 166/313; 166/387

(58) Field of Classification Search ..... 166/191, 166/305.1, 387, 313
See application file for complete search history.

(56) References Cited

U.S. PATENT DOCUMENTS

| | | | |
|---|---|---|---|
| 3,361,204 | A | 1/1968 | Howard |
| 4,919,989 | A | 4/1990 | Colangelo |
| 4,936,386 | A | 6/1990 | Colangelo |
| 5,048,605 | A | 9/1991 | Toon |
| 5,657,822 | A | 8/1997 | James et al. |
| 5,779,787 | A | 7/1998 | Brothers et al. |
| 5,810,085 | A | 9/1998 | James et al. |
| 6,431,282 | B1 | 8/2002 | Bosma et al. |
| 6,518,224 | B2 | 2/2003 | Wood |
| 6,834,725 | B2 | 12/2004 | Whanger et al. |
| 6,840,325 | B2 | 1/2005 | Stephenson |

(Continued)

FOREIGN PATENT DOCUMENTS

| | | | |
|---|---|---|---|
| GB | 2414259 | A | 8/2004 |

(Continued)

OTHER PUBLICATIONS

Foreign communication related to counterpart application dated Jun. 15, 2007.

(Continued)

*Primary Examiner*—Giovanna C Wright
(74) *Attorney, Agent, or Firm*—John W. Wustenberg; Baker Botts, L.L.P.

(57) ABSTRACT

Methods and devices are provided for treating multiple interval well bores. More particularly, an isolation assembly may be used to allow for zonal isolation to allow treatment of selected productive or previously producing intervals in multiple interval well bores. One example of a method for treating a multiple interval well bore includes the steps of: providing an isolation assembly comprising a liner and a plurality of swellable packers wherein the plurality of swellable packers are disposed around the liner at selected spacings; introducing the isolation assembly into the well bore; allowing at least one of the plurality of swellable packers to swell so as to provide zonal isolation of at least one of a plurality of selected intervals; establishing fluidic connectivity to the at least one of a plurality of selected intervals; and treating the at least one of a plurality of selected intervals.

20 Claims, 7 Drawing Sheets

U.S. PATENT DOCUMENTS

| | | | | |
|---|---|---|---|---|
| 6,848,505 | B2 | 2/2005 | Richard et al. | |
| 6,854,522 | B2 | 2/2005 | Brezinski et al. | |
| 6,907,937 | B2 | 6/2005 | Whanger et al. | |
| 6,976,542 | B2 | 12/2005 | Henriksen et al. | |
| 7,036,587 | B2 | 5/2006 | Munoz, Jr. et al. | |
| 2002/0104650 | A1 | 8/2002 | Dusterhoft et al. | 166/227 |
| 2004/0020662 | A1 | 2/2004 | Freyer | |
| 2004/0123983 | A1 | 7/2004 | Cook et al. | |
| 2004/0194971 | A1 | 10/2004 | Thomson | |
| 2005/0061508 | A1 | 3/2005 | Surjaatmadja | |
| 2005/0092485 | A1 | 5/2005 | Brezinski et al. | |
| 2005/0110217 | A1 | 5/2005 | Wood et al. | |
| 2005/0113260 | A1 | 5/2005 | Wood | |
| 2005/0167109 | A1 | 8/2005 | Hepburn et al. | |
| 2005/0173130 | A1 | 8/2005 | Richard | |
| 2005/0199401 | A1 | 9/2005 | Patel et al. | |
| 2005/0205263 | A1 | 9/2005 | Richard | |
| 2005/0241831 | A1 | 11/2005 | Steele et al. | |
| 2005/0252651 | A1 | 11/2005 | Bosma et al. | |
| 2006/0124310 | A1 | 6/2006 | Cardenas et al. | 166/313 |
| 2007/0062690 | A1* | 3/2007 | Witcher | 166/222 |
| 2007/0158060 | A1* | 7/2007 | Baaijens et al. | 166/65.1 |

FOREIGN PATENT DOCUMENTS

| | | | |
|---|---|---|---|
| GB | 2414259 | A | 11/2005 |
| GB | 2414495 | A | 11/2005 |
| WO | WO-02/059452 | A1 | 8/2002 |
| WO | WO-02/090714 | A1 | 11/2002 |
| WO | WO-03/008756 | A1 | 1/2003 |
| WO | WO 03/064811 | A2 | 8/2003 |
| WO | WO 03/064811 | A3 | 8/2003 |
| WO | WO-2004/027209 | A1 | 4/2004 |
| WO | WO-2004/057715 | A2 | 7/2004 |
| WO | WO-2004/072439 | A1 | 8/2004 |
| WO | WO-2005/031111 | A1 | 4/2005 |
| WO | WO 2005/090741 | | 9/2005 |
| WO | WO 2005/090741 | A1 | 9/2005 |
| WO | WO 2007/126496 | A3 | 11/2007 |
| WO | WO 2007/141465 | A1 | 12/2007 |
| WO | WO2007/141465 | A1 | 12/2007 |

OTHER PUBLICATIONS

International Search Report for International Application No. PCT/GB2007/001025, Jun. 15, 2007.

* cited by examiner

METHODS AND DEVICES FOR TREATING MULTIPLE-INTERVAL WELL BORES

BACKGROUND

The present invention relates to methods and devices for treating multiple interval well bores and more particularly, the use of an isolation assembly to provide zonal isolation to allow selected treatment of productive or previously producing intervals in multiple interval well bores.

Oil and gas wells often produce hydrocarbons from more than one subterranean zone or well bore interval. Occasionally, it is desired to treat or retreat one or more intervals of a well bore. Reasons for treating or retreating intervals of a well bore include the need to stimulate or restimulate an interval as a result of declining productivity during the life of the well. Examples of stimulation treatments include fracturing treatments and acid stimulation. Other treating operations include conformance treatments, sand control treatments, blocking or isolating intervals, consolidating treatments, sealing treatments, or any combination thereof.

One difficulty in treating a selected interval of an already producing well bore is the lack of zonal isolation between intervals. That is, each of the selected intervals to be treated may be in fluid communication with other intervals of the well bore. This lack of isolation between intervals can prevent targeted treatments to selected intervals because treatments intended for one selected interval may inadvertently flow into a nonintended interval. Thus, before treating or retreating a selected interval of a well bore, the selected interval will often be isolated from the other intervals of the well bore. In this way, treatments may be targeted to specific intervals.

Conventional methods for reisolation of well bore intervals include the use of isolation devices such as, for example, straddle packers, packers with sand plugs, packers with bridge plugs, isolation via cementing, and combinations thereof. Such conventional methods, however, can suffer from a number of disadvantages including lower rate throughputs due to additional well bore restrictions inherent in such methods, poor isolation between intervals, and depletion between intervals.

Thus, a need exists for an improved method for providing isolation between well bore intervals to allow treatment or retreatment of selected intervals in multiple interval well bores.

SUMMARY

The present invention relates to methods and devices for treating multiple interval well bores and more particularly, the use of an isolation assembly to provide zonal isolation to allow selected treatment of productive or previously producing intervals in a multiple interval well bore.

One example of a method for treating a multiple interval well bore comprises the steps of: providing an isolation assembly comprising a liner and a plurality of swellable packers wherein the plurality of swellable packers are disposed around the liner at selected spacings; introducing the isolation assembly into the well bore; allowing at least one of the plurality of swellable packers to swell so as to provide zonal isolation of at least one of a plurality of selected intervals; establishing fluidic connectivity to the at least one of a plurality of selected intervals; and treating the at least one of a plurality of selected intervals.

Another example of a method for refracturing a multiple interval well bore comprises the steps of: providing an isolation assembly comprising a liner and a plurality of swellable packers wherein the plurality of swellable packers are disposed around the liner at selected spacings; introducing the isolation assembly into the well bore; allowing at least one of the plurality of swellable packers to swell so as to provide zonal isolation of at least one of a plurality of selected intervals; establishing fluidic connectivity to the at least one of a plurality of selected intervals; and treating a selected well bore interval above or below the liner.

Yet another example of a method for refracturing a multiple interval well bore comprises the steps of: providing an isolation assembly comprising a liner and a plurality of swellable packers wherein the plurality of swellable packers are disposed around the liner at selected spacings; introducing the isolation assembly into the well; allowing at least one of the plurality of swellable packers to swell so as to provide zonal isolation of at least one of a plurality of selected intervals; establishing fluidic connectivity the at least one of a plurality of selected intervals; and stimulating the at least one of a plurality of selected intervals.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

The present invention relates to methods and devices for treating multiple interval well bores and more particularly, the use of an isolation assembly to provide zonal isolation to allow selected treatment of productive or previously producing intervals in a multiple interval well bore.

The methods and devices of the present invention may allow for reestablishing zonal isolation of producing intervals, bypassed, or non-producing intervals, or previously producing intervals in multiple interval well bores through the use of an isolation assembly. In certain embodiments, isolation assemblies of the present invention may comprise a liner and a plurality of swellable packers, the swellable packers being disposed about the liner at selected spacings.

To facilitate a better understanding of the present invention, the following examples of certain embodiments are given. In no way should the following examples be read to limit, or define, the scope of the invention.

Figure 1A:
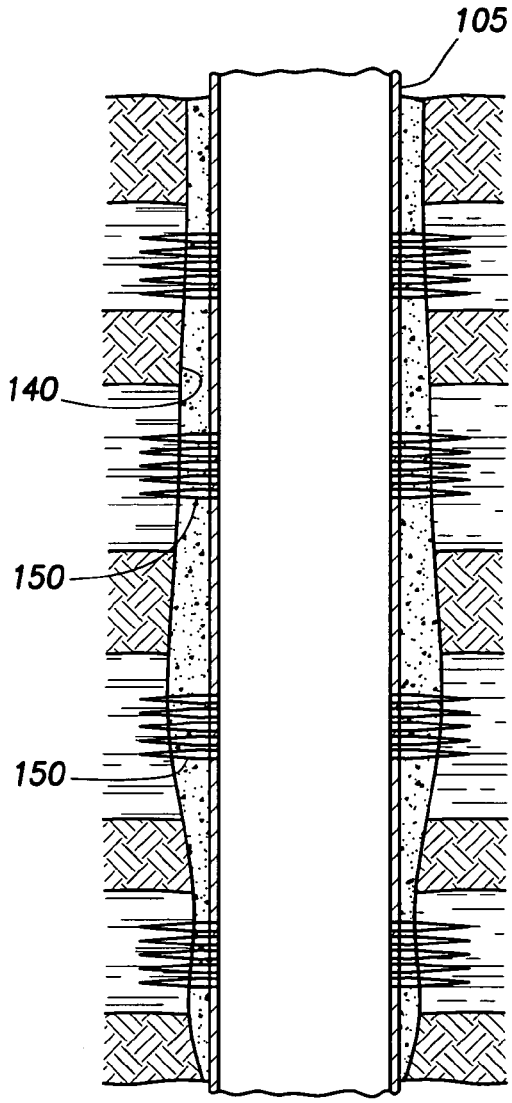
FIG. 1A (PRIOR ART)
FIG. 1A illustrates a well bore having a casing string disposed therein.

FIG. 1A illustrates a typical well bore completion. In FIG. 1, casing string 105 is disposed in well bore 140. Perforations 150 through casing string 105 permit fluid communication through casing string 105. In such a completion, treating or retreating a specific interval may be problematic, because each interval is no longer isolated from one another. To address this problem, FIG. 1B shows one embodiment of an apparatus for reestablishing isolation of previously unisolated well bore intervals of a longitudinal portion of a well bore.

Figure 1B:
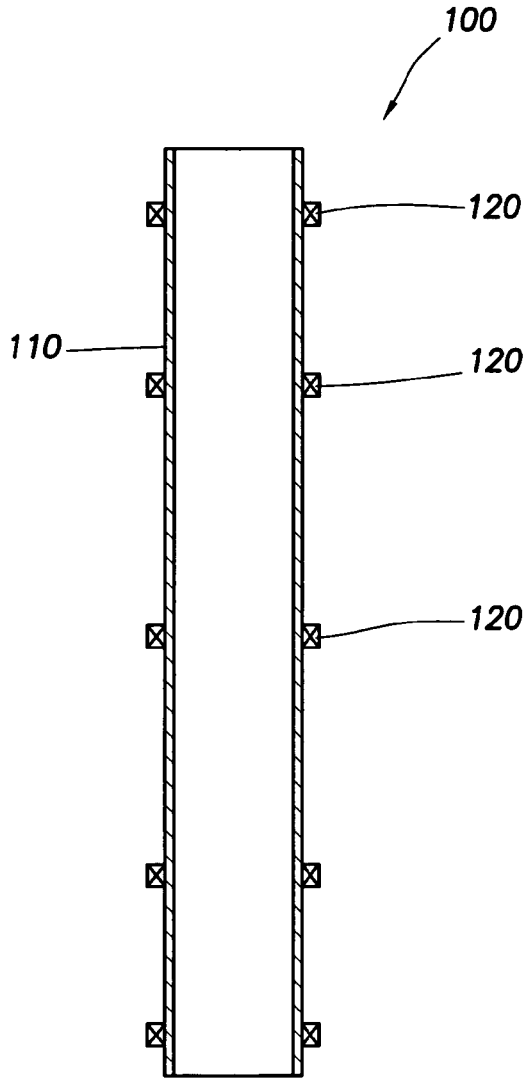
FIG. 1B illustrates a cross-sectional view of an isolation assembly comprising a liner and a plurality of swellable packers, the plurality of swellable packers being disposed about the liner at selected spacings in accordance with one embodiment of the present invention.

In particular, FIG. 1B illustrates a cross-sectional view of isolation assembly 100 comprising liner 110 and plurality of swellable packers 120. Plurality of swellable packers 120 may be disposed about the liner at selected spacings.

In certain embodiments, liner 110 may be installed permanently in a well bore, in which case, liner 110 may be made of any material compatible with the anticipated downhole conditions in which liner 110 is intended to be used. In other embodiments, liner 110 may be temporary and may be made of any drillable or degradable material. Suitable liner materials include, but are not limited to, metals known in the art (e.g. aluminum, cast iron), various alloys known in the art (e.g. stainless steel), composite materials, degradable materials, or any combination thereof. The terms "degradable," "degrade," "degradation," and the like, as used herein, refer to degradation, which may be the result of, inter alia, a chemical or thermal reaction or a reaction induced by radiation. Degradable materials include, but are not limited to dissolvable materials, materials that deform or melt upon heating such as thermoplastic materials, hydralytically degradable materials, materials degradable by exposure to radiation, materials reactive to acidic fluids, or any combination thereof. Further examples of suitable degradable materials are disclosed in U.S. Pat. No. 7,036,587, which is herein incorporated by reference in full.

Swellable packers 120 may be any elastomeric sleeve, ring, or band suitable for creating a fluid tight seal between liner 110 and an outer tubing, casing, or well bore in which liner 110 is disposed. Suitable swellable packers include, but are not limited, to the swellable packers disclosed in U.S. Patent US 2004/0020662, which is herein incorporated by reference in full.

It is recognized that each of the swellable packers 120 may be made of different materials, shapes, and sizes. That is, nothing herein should be construed to require that all of the swellable packers 120 be of the identical material, shape, or size. In certain embodiments, each of the swellable packers 120 may be individually designed for the conditions anticipated at each selected interval, taking into account the expected temperatures and pressures for example. Suitable swellable materials include ethylene-propylene-copolymer rubber, ethylene-propylene-diene terpolymer rubber, butyl rubber, halogenated butyl rubber, brominated butyl rubber, chlorinated butyl rubber, chlorinated polyethylene, styrene butadiene, ethylene propylene monomer rubber, natural rubber, ethylene propylene diene monomer rubber, hydragenized acrylonitrile-butadiene rubber, isoprene rubber, chloroprene rubber, and polynorbornene. In certain embodiments, only a portion of the swellable packer may comprise a swellable material.

Figure 2:
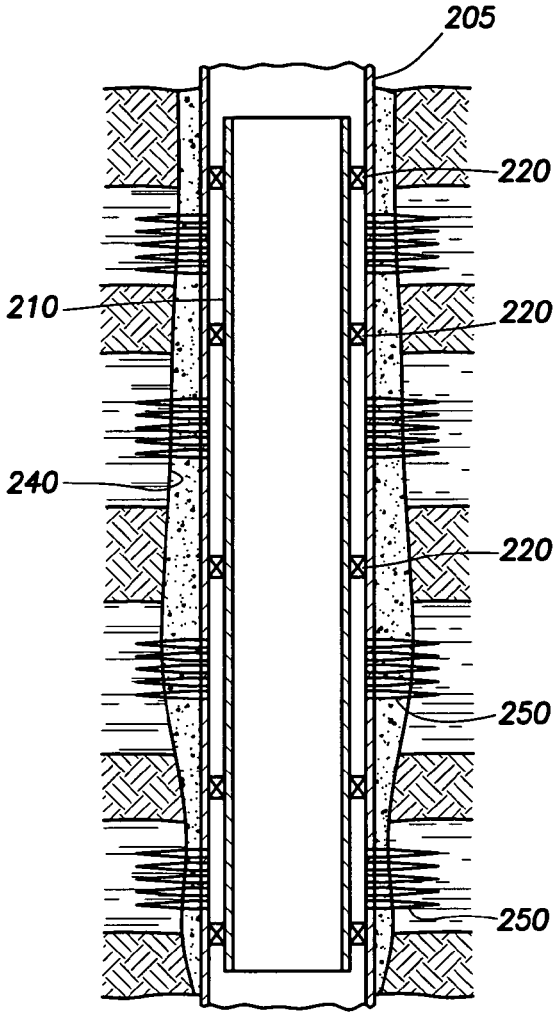
FIG. 2 illustrates a cross-sectional view of an isolation assembly in a well bore providing isolation of selected intervals of a well bore in accordance with one embodiment of the present invention.

FIG. 2 illustrates a cross-sectional view of isolation assembly 200 disposed in casing string 205 of well bore 240 for reestablishing isolation of previously unisolated well bore intervals. Although well bore 240 is depicted here as a vertical well, it is recognized that isolation assembly 200 may be used in horizontal and deviated wells in addition to vertical wells. Additionally, it is expressly recognized that isolation assembly 200 may extend the entire length of well bore 240 (i.e., effectively isolating the entire casing string) or only along a longitudinal portion of well bore 240 as desired. Additionally, isolation assembly 200 may be formed of one section or multiple sections as desired. In this way, isolation may be provided to only certain longitudinal portions of the well bore. In certain embodiments, isolation assembly 200 may be a stacked assembly.

As is evident from FIG. 2, casing string 205 has perforations 250, which allow fluid communication to each of the perforated intervals along the well bore. The isolation assembly (i.e. liner 210 and swellable packers 220) may be introduced into casing string 210.

The swelling of plurality of swellable packers 220 may cause an interference fit between liner 210 and casing string 205 so as to provide fluidic isolation between selected intervals along the length of the well bore. The fluidic isolation may provide zonal isolation between intervals that were previously not fluidly isolated from one another. In this way, integrity of a previously perforated casing may be reestablished. That is, the isolation assembly can reisolate intervals from one another as desired. By reestablishing the integrity of the well bore in this way, selected intervals may be treated as desired as described more fully below.

The swelling of the swellable packers may be initiated by allowing a reactive fluid, such as for example, a hydrocarbon to contact the swellable packer. In certain embodiments, the swelling of the swellable packers may be initiated by spotting the reactive fluid across the swellable packers with a suitable fluid. The reactive fluid may be placed in contact with the swellable material in a number of ways, the most common being placement of the reactive fluid into the wellbore prior to installing the liner. The selection of the reactive fluid depends on the composition of the swellable material as well as the well bore environment. Suitable reaction fluids include any hydrocarbon based fluids such as crude oil, natural gas, oil based solvents, diesel, condensate, aqueous fluids, gases, or any combination thereof. U.S. Patent Publication 2004/

0020662 describes a hyrdocarbon swellable packer, and U.S. Pat. No. 4,137,970 describes a water swellable packer, both of which is hereby incorporated by reference. Norwegian Patent 20042134, which is hereby incorporated by reference, describes a swellable packer, which expands upon exposure to gas. The spotting of the swellable packers may occur before, after, or during the introduction of the isolation assembly into the well bore. In some cases, a reservoir fluid may be allowed to contact the swellable packers to initiate swelling of the swellable packers.

After fluidic isolation of selected intervals of the well bore has been achieved, fluidic connectivity may be established to selected intervals of the well bore. Any number of methods may be used to establish fluidic connectivity to a selected interval including, but not limited to, perforating the liner at selected intervals as desired.

Selected intervals may then be treated with a treatment fluid as desired. Selected intervals may include bypassed intervals sandwiched between previously producing intervals and thus packers should be positioned to isolate this interval even though the interval may not be open prior to the installation of liner 210. Further, packers may be positioned to isolate intervals that will no longer be produced such as intervals producing excessive water.

As used herein, the terms "treated," "treatment," "treating," and the like refer to any subterranean operation that uses a fluid in conjunction with a desired function and/or for a desired purpose. The terms "treated," "treatment," "treating," and the like as used herein, do not imply any particular action by the fluid or any particular component thereof. In certain embodiments, treating of a selected interval of the well bore may include any number of subterranean operations including, but not limited to, a conformance treatment, a consolidation treatment, a sand control treatment, a sealing treatment, or a stimulation treatment to the selected interval. Stimulation treatments may include, for example, fracturing treatments or acid stimulation treatments.

Figure 3A:
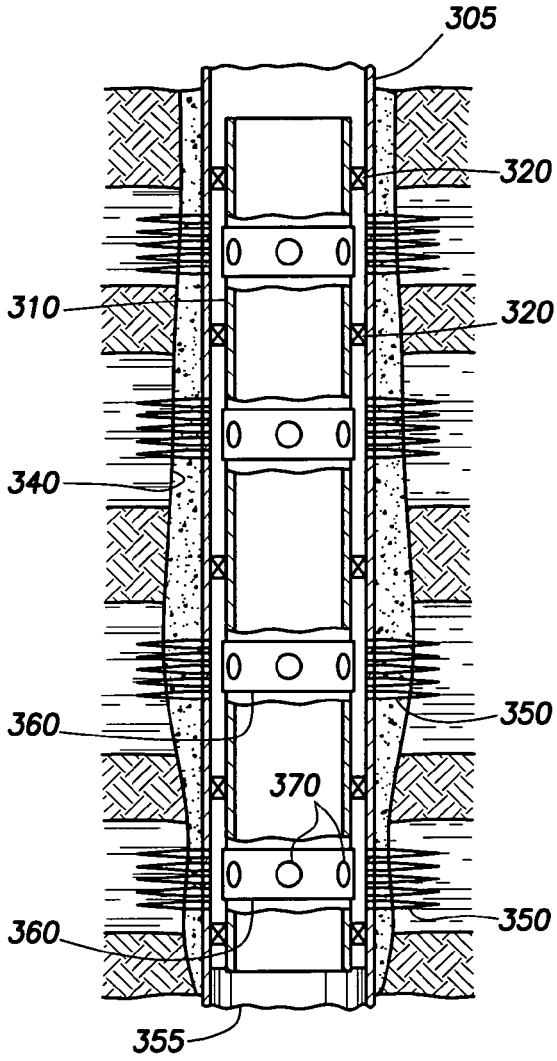
FIG. 3A illustrates a cross-sectional view of an isolation assembly in a well bore providing isolation of selected intervals of a well bore showing certain optional features in accordance with one embodiment of the present invention.

FIG. 3A illustrates a cross-sectional view of an isolation assembly in a well bore providing isolation of selected intervals of a well bore showing certain optional features in accordance with one embodiment of the present invention.

Liner 310 may be introduced into well bore 340 by any suitable method for disposing liner 310 into well bore 340 including, but not limited to, deploying liner 310 with jointed pipe or setting with coiled tubing. If used, any liner hanging device may be sheared so as to remove the coiled tubing or jointed pipe while leaving the previously producing intervals isolated. Optionally, liner 340 can include a bit and scraper run on the end of the liner for the purpose of removing restrictions in the casing while running liner 310. In certain embodiments, liner 310 may be set on the bottom of well bore 340 until swellable packers 320 have swollen to provide an interference fit or fluidic seal sufficient to hold liner 310 in place. Alternatively, liner 310 may set on bridge plug 355 correlated to depth, or any suitable casing restriction of known depth. Here, liner 305 is depicted as sitting on bridge plug 355, which may be set via a wireline. In this way, bridge plug 355 may serve as a correlation point upon which liner 310 is placed when it is run into the casing. In certain embodiments, liner 310 may a full string of pipe to the surface, effectively isolating the entire casing string 310, or in other embodiments, liner 310 may only isolate a longitudinal portion of casing string 310.

As previously described, once liner 310 is in place and the swellable packers have expanded to provide fluidic isolation between the intervals, selected intervals may be isolated and perforated as desired to allow treatment of the selected intervals. Any suitable isolation method may be used to isolate selected intervals of the liner including, but not limited to, a ball and baffle method, packers, nipple and slickline plugs, bridge plugs, sliding sleeves, particulate or proppant plugs, or any combination thereof.

Before treatment of selected intervals, liner 310 may be perforated to allow treating of one or more selected intervals. The term "perforated" as used herein means that the member or liner has holes or openings through it. The holes can have any shape, e.g. round, rectangular, slotted, etc. The term is not intended to limit the manner in which the holes are made, i.e. it does not require that they be made by perforating, or the arrangement of the holes.

Any suitable method of perforating liner 310 may be used to perforate liner 310 including but not limited to, conventional perforation such as through the use of perforation charges, preperforated liner, sliding sleeves or windows, frangible discs, rupture disc panels, panels made of a degradable material, soluble plugs, perforations formed via chemical cutting, or any combination thereof. In certain embodiments, a hydrajetting tool may be used to perforate the liner. In this way, fluidic connectivity may be reestablished to each selected interval as desired. Here, in FIG. 3A, sliding sleeves 360 may be actuated to reveal liner perforations 370. Liner perforations 370 may be merely preinstalled openings in liner 310 or openings created by either frangible discs, degradation of degradable panels, or any other device suitable for creating an opening in liner 310 at a desired location along the length of liner 310.

In certain embodiments, sliding sleeves 360 may comprise a fines mitigation device such that sliding sleeve 360 may function so as to include an open position, a closed position, and/or a position that allows for a fines mitigation device such as a sand screen or a gravel pack to reduce fines or proppant flowback through the aperture of sliding sleeve 360.

Figure 3B:
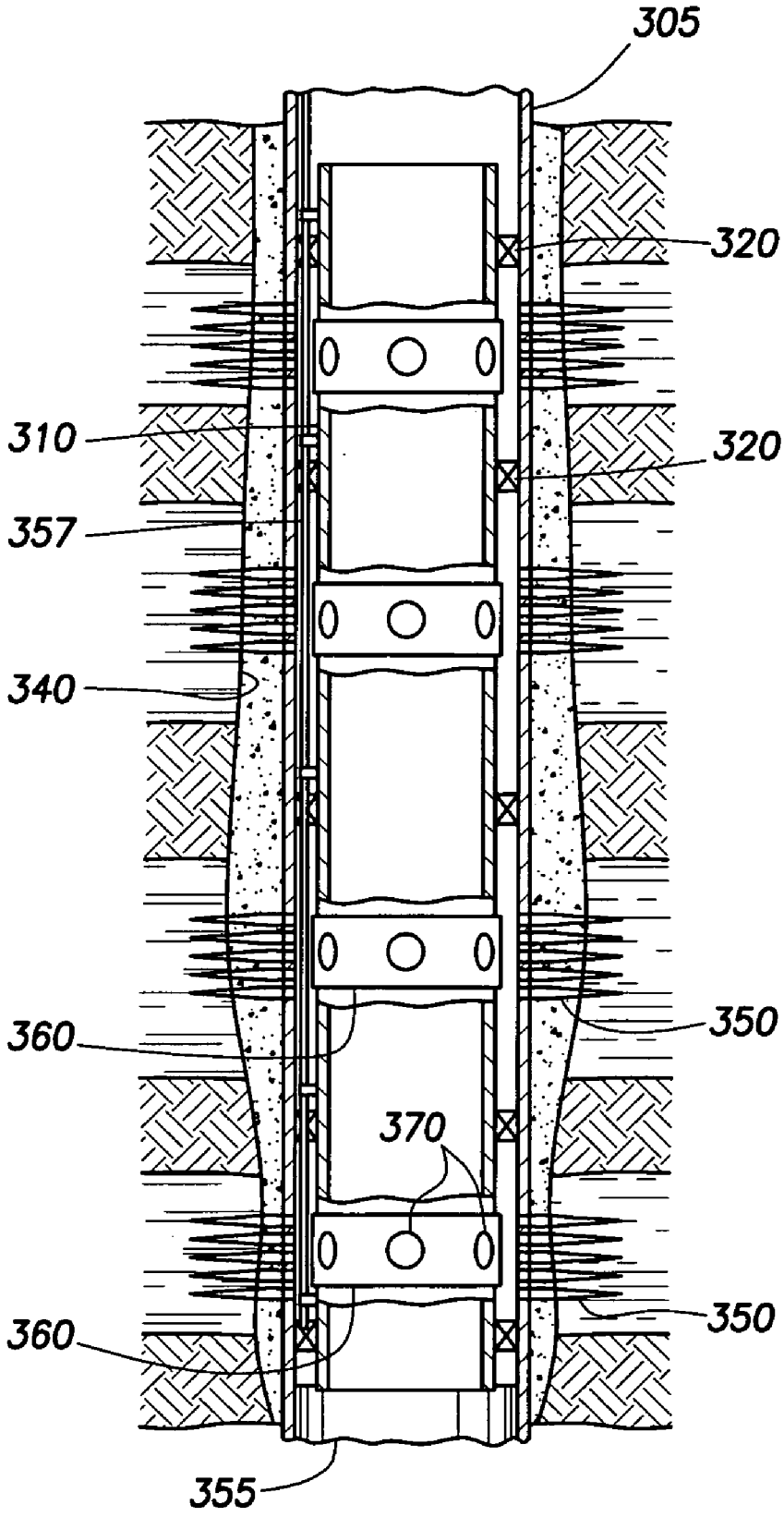
FIG. 3B illustrates a cross-sectional view of an isolation assembly in a well bore providing isolation of selected intervals of a well bore showing certain optional features in accordance with one embodiment of the present invention.

Certain embodiments may include umbilical line, wirelines, or tubes to the surface could be incorporated to provide for monitoring downhole sensors, electrically activated controls of subsurface equipment, for injecting chemicals, or any combination thereof. For example, in FIG. 3B, umbilical line 357 could be used, to actuate remote controlled sliding sleeves 360. Umbilical line 357 may run in between liner 310 and swellable packers 320, or umbilical line 357 may be run through swellable packers 320 as depicted in FIG. 3B. Umbilical line 357 may also be used as a chemical injection line to inject chemicals or fluids such as spotting treatments, nitrogen padding, $H_2S$ scavengers, corrosion inhibitors, or any combination thereof.

Although liner 310 and swellable packers 320 are shown as providing isolation along casing string 305, it is expressly recognized that liner 310 and swellable packers 320 may provide isolation to an openhole without a casing string or to a gravel pack as desired. Thus, casing string 305 is not a required feature in all embodiments of the present invention. In other words, the depiction of casing string 305 in the figures is merely illustrative and should in no way require the presence of casing string 305 in all embodiments of the present invention.

Figure 4:
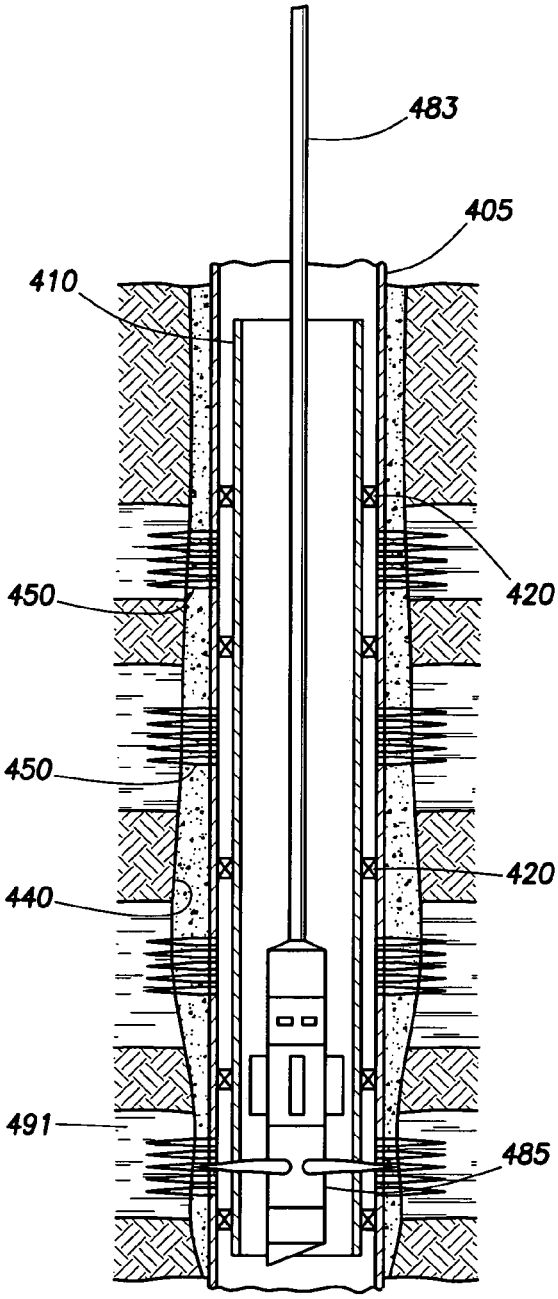
FIG. 4 illustrates a cross-sectional view of an isolation assembly in a wellbore providing isolation of selected intervals of a wellbore with hydra-jet perforating being performed on the lower most interval using coiled tubing.

As selected intervals are appropriately isolated and perforated using the isolation assembly, selected intervals may be treated as desired. FIG. 4 illustrates hydrajetting tool 485 introduced into liner 410 via coiled tubing 483. As depicted here, hydrajetting tool 485 may be used to perforate casing string 405 and initiate or enhance perforations into first well bore interval 491. Then, as desired, first interval 491 may be stimulated with hydrajetting tool 485 or by introducing a stimulation fluid treatment into liner 405. As would be recognized by a person skilled in the art with the benefit of this disclosure, the isolation and perforation of selected intervals may occur in a variety of sequences depending on the particular well profile, conditions, and treatments desired. In certain embodiments, several intervals may be perforated before isolation of one or more selected intervals. Several methods of perforating and fracturing individual layers exist. One method uses select-fire perforating on wireline with ball sealer diversion in between treatments. Another method uses conventional perforating with drillable bridge plugs set between treatments. Yet another method uses sliding windows that are open and closed with either wireline or coiled tubing between treatments. Another method uses retrievable bridge plugs and hydrajetting moving the bridge plug between intervals. Other methods use limited-entry perforating, straddle packer systems to isolate conventionally perforated intervals, and packers on tubing with conventional perforating.

Examples of suitable treatments that may be apply to each selected interval include, but are not limited to, stimulation treatments (e.g. a fracturing treatment or an acid stimulation treatment), conformance treatments, sand control treatments, consolidating treatments, sealing treatments, or any combination thereof. Additionally, whereas these treating steps are often performed as to previously treated intervals, it is expressly recognized that previously bypassed intervals may be treated in a similar manner.

Figure 5A:
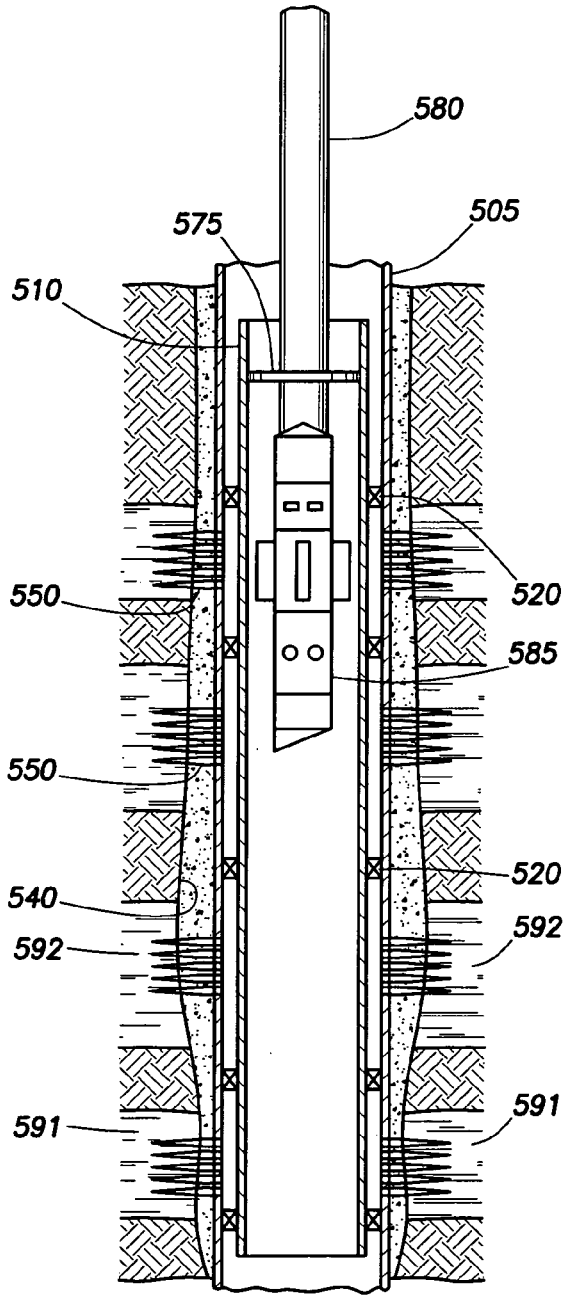
FIG. 5A illustrates placement of an isolation assembly into a well bore via a jointed pipe attached to a hydrajetting tool so as to allow a one trip placement and treatment of a multiple interval well bore in accordance with one embodiment of the present invention.

FIG. 5A illustrates placement of an isolation assembly into a well bore via a jointed pipe attached to a hydrajetting tool so as to allow a one trip placement and treatment of a multiple interval well bore in accordance with one embodiment of the present invention. One of the advantages of this implementation of the present invention includes the ability to set isolation assembly and perform perforation and treatment operations in a single trip in well bore 540. Jointed pipe 580 may be used to introduce liner 510 into well bore 540. More particularly, jointed pipe 580 is attached to liner 510 via attachment 575. After liner 510 is introduced into well bore 540, swellable packers may be allowed to swell to create a fluid tight seal against casing string 505 so as to isolate or reisolate the well bore intervals of well bore 540. Once liner 510 is set in place, attachment 575 may be sheared or otherwise disconnected from liner 510.

Figure 5B:
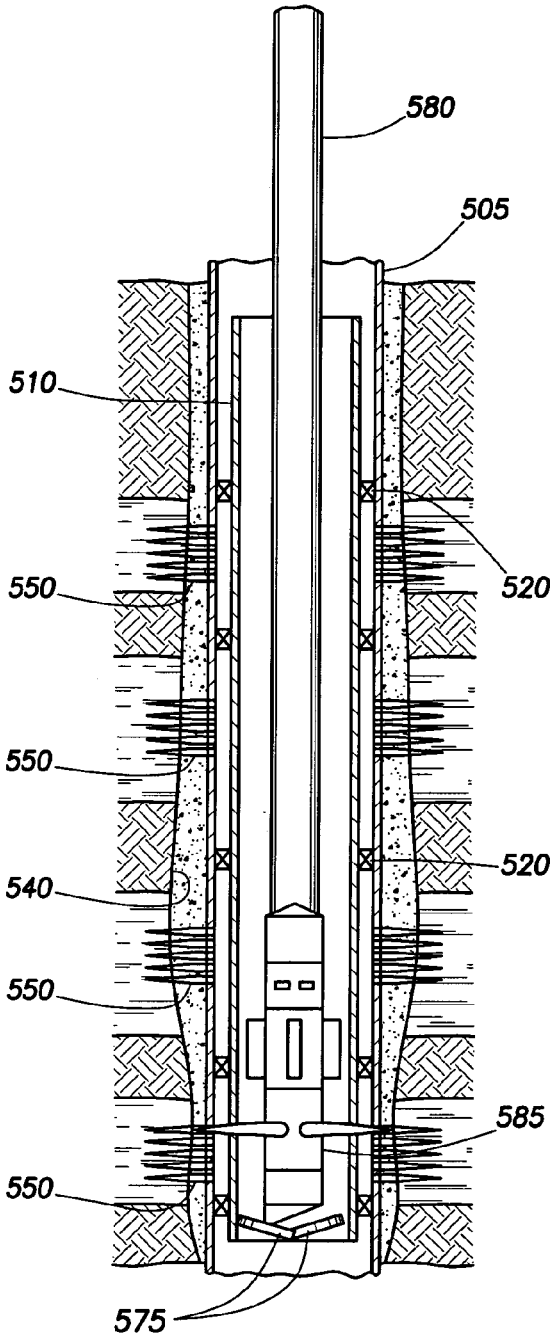
FIG. 5B illustrates a hydrajetting tool lowered to a well bore interval to be treated, the hydrajetting tool perforating the liner and initiating or enhancing perforations into a selected interval of a well bore.
Figure 5C:
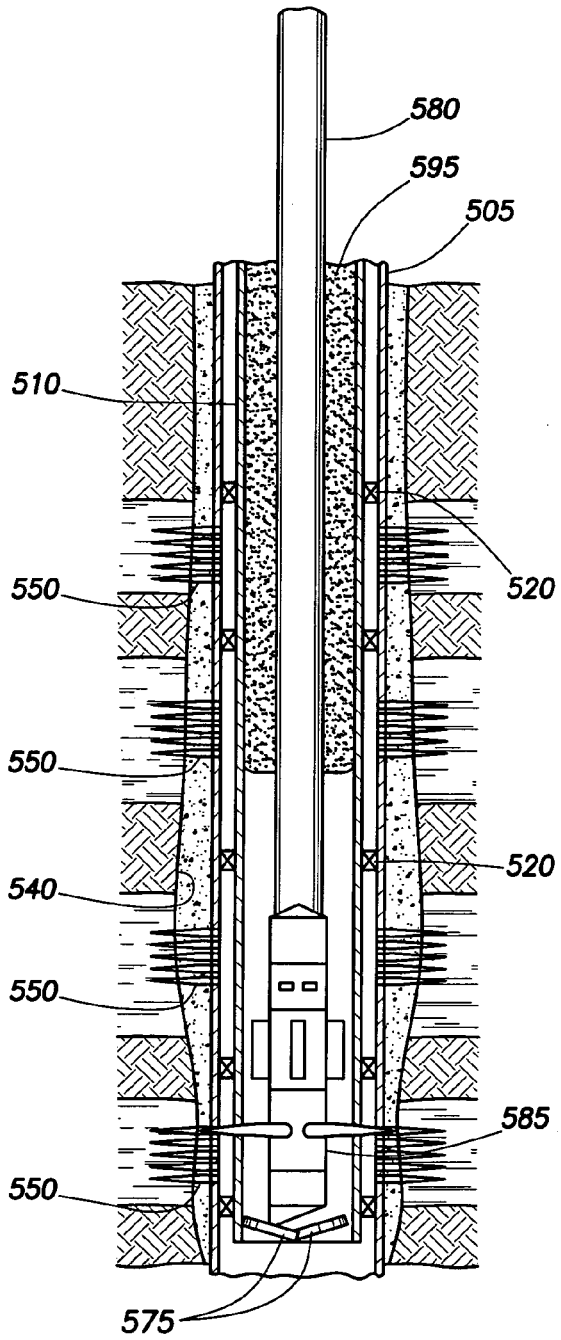
FIG. 5C illustrates the introduction of a fluid treatment to treat a selected interval of a multiple interval well bore.
Figure 5D:
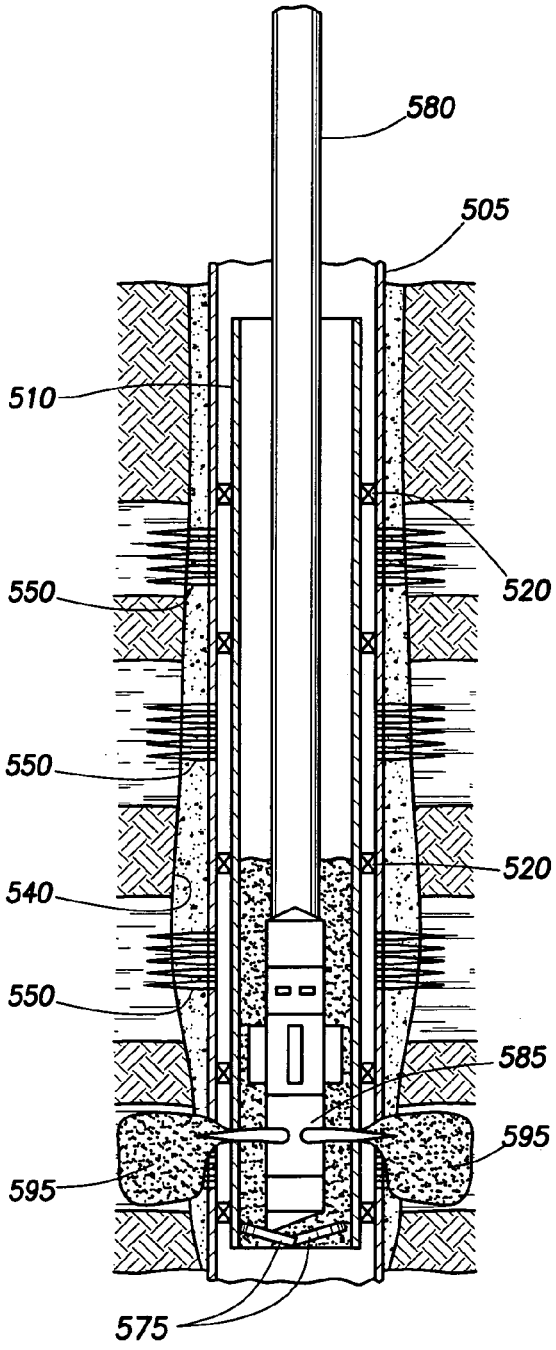
FIG. 5D illustrations treatment of a selected interval of a multiple interval well bore with a fluid treatment.
Figure 5E:
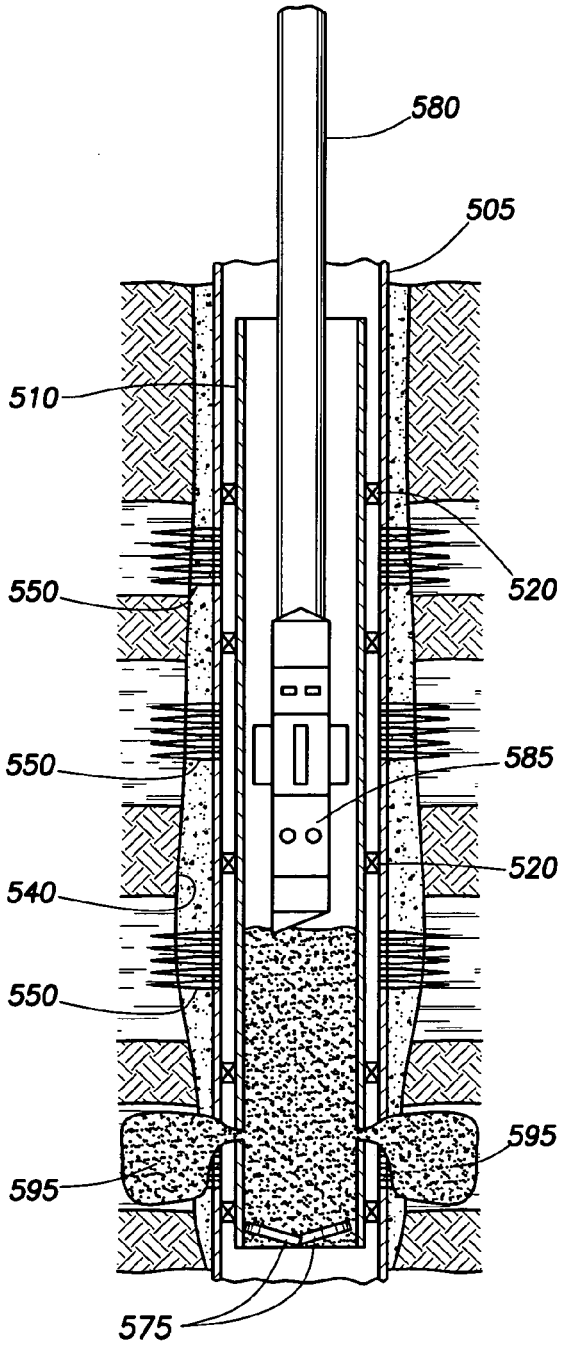
FIG. 5E illustrates hydrajetting tool retracted from first well bore interval 591 to above a diversion proppant plug of fracturing treatment.
Figure 5F:
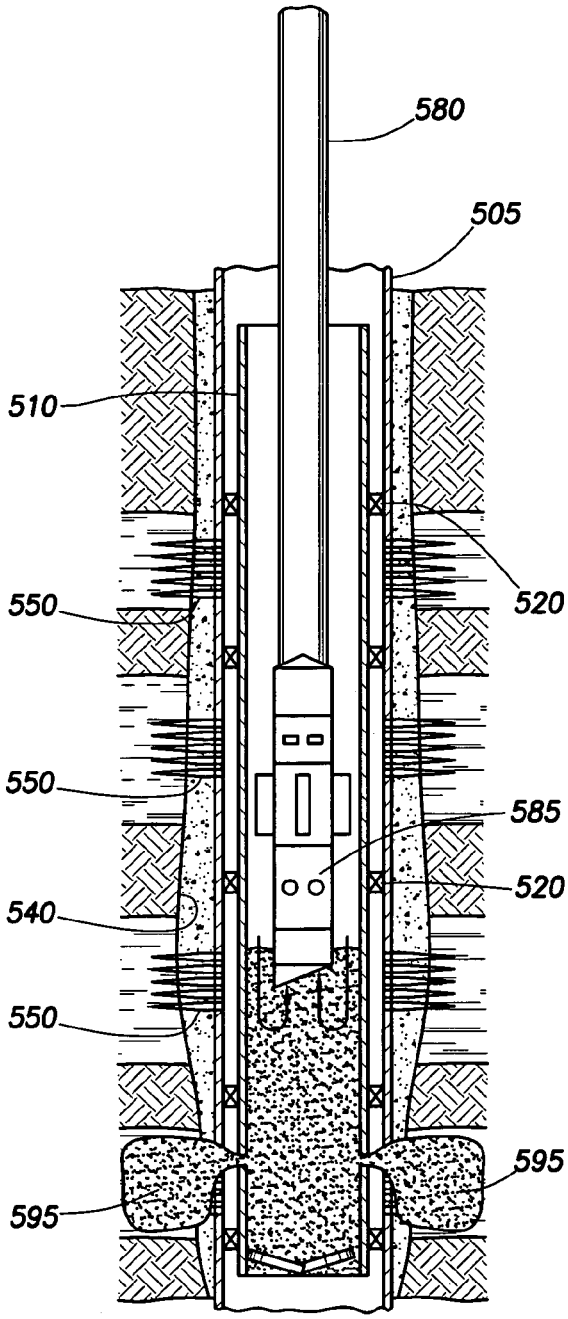
FIG. 5F illustrates excess proppant being removed by reversing out a proppant diversion plug to allow treatment of another selected well bore interval of interest.

Once attachment 575 is sheared or otherwise disconnected, hydrajetting tool 585 may be lowered to a well bore interval to be treated, in this case, first well bore interval 591 as illustrated in FIG. 5B. As depicted here, hydrajetting tool 585 may be used to perforate casing string 505 and initiate or enhance perforations into first well bore interval 591. Then, as illustrated in FIG. 5C, a fluid treatment (in this case, fracturing treatment 595) may be introduced into liner 510 to treat first well bore interval 591. In FIG. 5D, fracturing treatment 595 is shown being applied to first well bore interval 591. At some point, after perforating first wellbore interval 591 with hydrajetting tool 585, hydrajetting tool 585 may be retracted to a point above the anticipated top of the diversion proppant plug of the fracturing treatment. In FIG. 5E, hydrajetting tool 585 is retracted from first well bore interval 591 above the diversion proppant plug of fracturing treatment 595. In FIG. 5F, excess proppant is removed by reversing out the proppant diversion plug to allow treatment of the next well bore interval of interest.

Figure 5G:
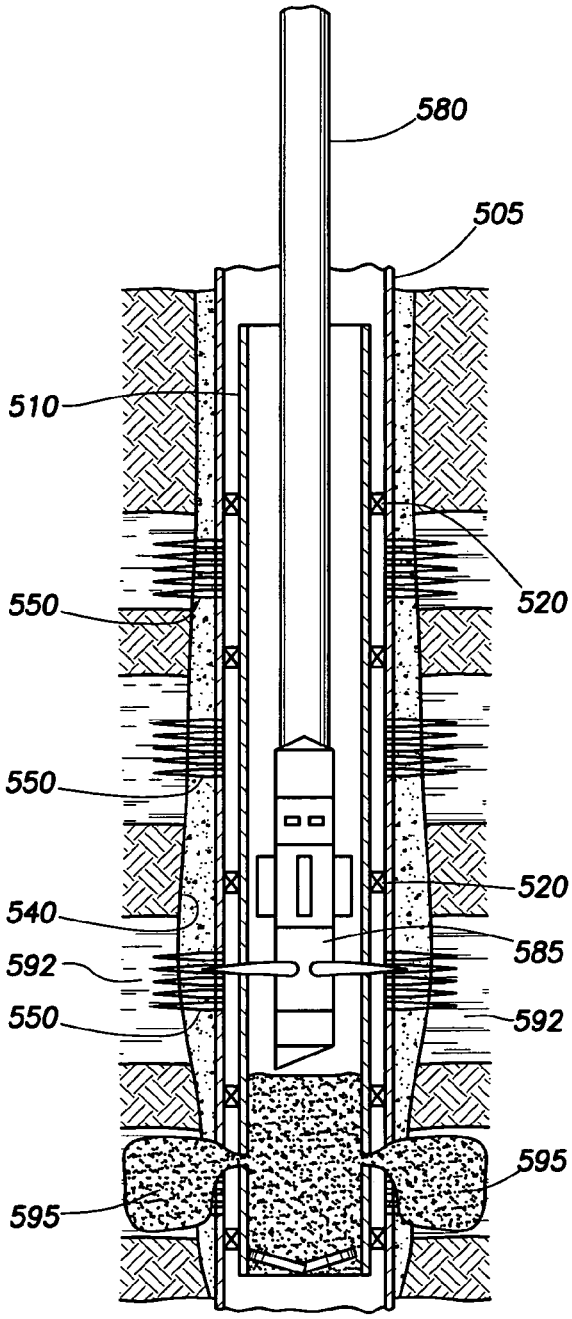
FIG. 5G illustrates a hydrajetting tool perforating the liner and initiating or enhancing perforations into a subsequent selected interval so as to allow treatment thereof.

After removal of the excess proppant, hydrajetting tool 585 may be used to perforate casing string 505 and initiate or enhance perforations into second well bore interval 592 as illustrated in FIG. 5G. Fluid treatments may then be applied to second well bore interval 592. In a like manner, other well bore intervals of interest may be perforated and treated or retreated as desired. Additionally, it is expressly recognized that bypassed intervals between two producing intervals may likewise be perforated and treated as well.

As a final step in the process the tubing may be lowered while reverse circulating to remove the proppant plug diversion and allow production from the newly perforated and stimulated intervals.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for treating a multiple interval well bore comprising the steps of:

providing an isolation assembly comprising a liner and a plurality of swellable packers wherein the plurality of swellable packers are disposed around the liner at selected spacings;

introducing the isolation assembly into the well bore;

allowing at least one of the plurality of swellable packers to swell so as to provide zonal isolation of at least one of a plurality of selected intervals;

wherein the selected intervals are productive intervals or previously producing intervals;

establishing fluidic connectivity to the at least one of a plurality of selected intervals; and treating the at least one of a plurality of selected intervals;

wherein treating the at least one of a plurality of selected intervals comprises:

perforating the selected interval;

introducing a fluid treatment in the selected interval through the liner; and packing the selected interval.

2. The method of claim 1 wherein the step of allowing at least one of the plurality of swellable packers to swell comprises the step of introducing a spotting fluid into the well bore so as to contact at least one of the plurality of swellable packers.

3. The method of claim 1 wherein the step of establishing fluidic connectivity to the at least one of a plurality of selected intervals comprises the step of perforating the liner.

4. The method of claim 1 wherein the casing isolation assembly further comprises a frangible disc capable of establishing fluidic connectivity to the at least one of a plurality of selected intervals upon application of pressure to the frangible disc beyond the burst pressure of the frangible disc.

5. The method of claim 1 wherein the isolation assembly further comprises a sliding window capable of establishing fluidic connectivity by actuation of the sliding window to an open position.

6. The method of claim 5 wherein the sliding window is capable of reestablishing zonal isolation of the at least one of a plurality of selected intervals by closing the sliding window.

7. The method of claim 5 wherein the sliding window further comprises a fines mitigation device.

8. The method of claim 1 wherein the isolation assembly further comprises an umbilical line.

9. The method of claim 8 wherein the umbilical line is adapted to relay data from a remote sensor.

10. The method of claim 8 wherein the umbilical line is adapted to allow actuation of remotely actuated devices downhole.

11. The method of claim 8 wherein the umbilical line is capable of allowing an injection of chemicals.

12. The method of claim 1 further comprising the step of isolating a longitudinal portion of the liner wherein the step of isolating is performed by a ball and baffle method, a packer, nipple and slickline plugs, a bridge plug, a sliding sleeve, a particulate plug, a proppant plug, or any combination thereof.

13. The method of claim 12 further comprising the step of treating a second selected well bore interval.

14. The method of claim 1 wherein the fluid treatment comprises a fracturing treatment or an acid stimulation treatment.

15. The method of claim 1 wherein the step of introducing a fluid treatment comprises applying a conformance treatment to the at least one of a plurality of selected intervals, isolating at least one selected well bore interval, applying a sand control treatment to the at least one of a plurality of selected intervals, or sealing the at least one of a plurality of selected intervals.

16. The method of claim 1 wherein the step of treating comprises sealing a previously bypassed well bore interval.

17. The method of claim 1 wherein a casing string is disposed within the well bore, the casing string having at least one perforation and wherein introducing the isolation assembly into the well bore results in the isolation assembly being disposed within a casing string.

18. The method of claim 1 further comprising introducing an additional isolation assembly into the well bore.

19. A method for treating a multiple interval well bore comprising the steps of:

providing an isolation assembly comprising a liner and a plurality of swellable packers wherein the plurality of swellable packers are disposed around the liner at selected spacings;

introducing the isolation assembly into the well bore;

allowing at least one of the plurality of swellable packers to swell so as to provide zonal isolation of at least one of a plurality of selected intervals;

wherein the selected intervals are productive intervals or previously producing intervals;

establishing fluidic connectivity to the at least one of a plurality of selected intervals; and treating a selected well bore interval above or below the liner;

wherein treating the selected well bore interval comprises:

perforating the selected interval;

introducing a fluid treatment in the selected interval through the liner; and packing the selected interval.

20. A method for refracturing a multiple interval well bore comprising the steps of:

providing an isolation assembly comprising a liner and a plurality of swellable packers wherein the plurality of swellable packers are disposed around the liner at selected spacings;

introducing the isolation assembly into the well;

allowing at least one of the plurality of swellable packers to swell so as to provide zonal isolation of at least one of a plurality of selected intervals;

wherein the selected intervals are productive intervals or previously producing intervals;

establishing fluidic connectivity to the at least one of a plurality of selected intervals; and stimulating the at least one of a plurality of selected intervals;

wherein simulating the at least one of a plurality of selected intervals comprises:

perforating the selected interval;

introducing a fluid treatment in the selected interval through the liner; and packing the selected interval.

* * * * *